United States Patent [19]

Lauder et al.

[11] 4,069,142

[45] Jan. 17, 1978

[54] HYDROCARBON SEPARATING PROCESS

[75] Inventors: Brian Tait Lauder, Virginia Waters; John Robert Kenneth Rolfe, Esher, both of England

[73] Assignee: The British Petroleum Company Limited, Sunbury-on-Thames, England

[21] Appl. No.: 717,584

[22] Filed: Aug. 25, 1976

[30] Foreign Application Priority Data

Sept. 15, 1975 United Kingdom ..... 37746/75

[51] Int. Cl.[2] ..... C07C 7/13; C10G 25/10

[52] U.S. Cl. ..... 208/310 Z; 260/676 MS

[58] Field of Search ..... 208/310 Z; 260/676 MS

[56] References Cited

U.S. PATENT DOCUMENTS 3,428,552 2/1969 Turnbull ..... 208/310 Z

*Primary Examiner*—Herbert Levine

*Attorney, Agent, or Firm*—Morgan, Finnegan, Pine, Foley & Lee

[57] ABSTRACT

A cyclic, vapor-phase, pressure swing process for the separation of n-paraffins from a mixture with non-straight chain hydrocarbons comprises the steps of adsorption purge and desorption. Purge effluent is recycled through a bed of a 5 A molecular sieve in an adsorption stage and an effluent of reduced n-paraffin content is recovered. The bed is purged to remove surface adsorbed and interstitial matter by reducing the pressure in the bed by direct contact condensation with fresh feed introduced at or near ambient temperature. A purge effluent is recovered for recycle to stage (1). The bed is then desorbed to recover n-paraffins by further reducing the pressure in the bed.

10 Claims, 1 Drawing Figure

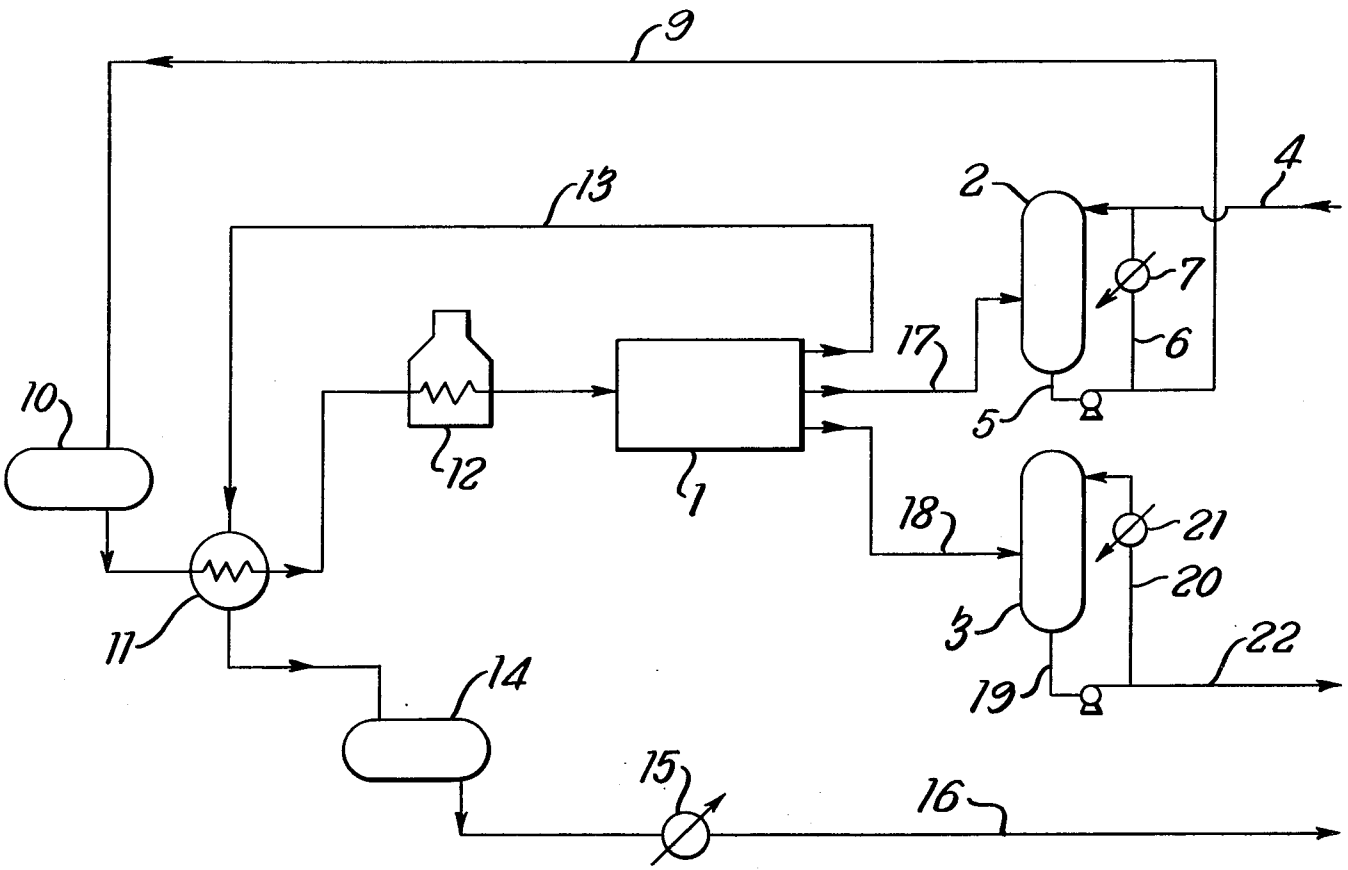
4
7
6
2
5
17
9
13
1
12
10
11
14
15
16
21
20
22
3
19
18

HYDROCARBON SEPARATING PROCESS

This invention relates to a cyclic process for the separation of n-paraffins from mixtures thereof together with non-straight chain hydrocarbons, e.g., aromatics, cycloparaffins and isoparaffins, using a bed of a 5 A molecular sieve.

The separation of n-paraffins from non-straight chain hydrocarbons, especially cycloparaffins and/or isoparaffins using a 5 A molecular sieve has been previously described, e.g., in British patent specification No. 1026116 which claims a process for separating straight-chain hydrocarbons from mixtures of the same with branched chain and/or cyclic hydrocarbons, the mixtures boiling within the range $C_4$ - 450° C, comprising contacting the mixture with a fixed bed of 5 A molecular sieve in a first stage selectively to adsorb the straight chain hydrocarbons, purging the sieve bed in a second stage to remove surface absorbed and interstitially held hydrocarbons from the sieve bed, and desorbing the adsorbed straight-chain hydrocarbons in a third stage, all three stages being conducted isothermally in the vapour phase, purging and desorption being effected by pressure variation alone.

In such a process, only the n-paraffins are able to enter the pores of the sieve, i.e., be adsorbed, and when the feed mixture is passed over the bed of the sieve the branched chain and cyclic components emerge in the effluent and the n-paraffins are adsorbed. The n-paraffins are subsequently removed in a separate stage called a desorption stage.

Our British Pat. No. 1110494, the parent patent, claims a cyclic vapour phase adsorption-desorption process for separating adsorbable components from mixtures thereof with non-adsorbable components by means of a fixed bed of a solid selective adsorbent, wherein the desorption step is effected by drawing a partial vacuum on the adsorbent bed by directly condensing with a quench liquid the effluent vapour from the adsorbent bed during the desorption stage.

In a preferred embodiment, a purge stage is interposed between the adsorption and desorption stages in order to remove surface-absorbed and interstitially held material from the adsorbent bed, the purging step being effected by drawing a partial vacuum on the adsorbent bed by directly condensing with a quench liquid the effluent vapours from the adsorbent bed during the purging stage, so as to reduce the pressure in the adsorbent bed during the purging stage to a level intermediate the adsorption and desorption stage pressures.

A convenient and preferred method of quenching is to pass the effluent vapours up a condenser tower down which the quench liquid is caused to flow and to use a portion of the liquid drawn off from the base of the condenser tower as the quench liquid.

In the process of the parent patent, fresh feed is normally introduced by way of a feed heater to an adsorber and quench liquid for the purge condenser is cooled between its point of withdrawal at or near the base of the condenser and its point of entry at or near the top.

We have now discovered that more efficient energy utilisation can be achieved by introducing relatively cold feed to the purge condenser and utilising this material as a quench liquid.

Thus according to the present invention there is provided a cyclic, vapour-phase, pressure-swing process for the separation of n-paraffins from a mixture thereof with non-straight chain hydrocarbons comprising the steps of adsorption, purge and desorption, which process comprises (1) recycling purge effluent through a bed of a 5 A molecular sieve in an adsorption stage and recovering an effluent of reduced n-paraffin content, (2) purging the bed to remove surface adsorbed and interstitial matter by reducing the pressure in the bed by direct contact condensation with fresh feed introduced at or near ambient temperature and recovering a purge effluent for recycle to Stage (1), and (3) desorbing the bed to recover n-paraffins by further reducing the pressure in the bed.

The feedstock may be a gasoline, kerosine or gas oil fraction. In the present specification the terms gasoline, kerosine, and gas oil have their normal meanings as used in the petroleum industry, i.e., they refer respectively to fractions boiling substantially within the ranges $C_4$ - 200° C, 150°-300° C, and 200°-450° C.

Preferred operating temperatures for different range feedstocks are 300°-380° C for gasoline, 350°-400° C for kerosine, and 380°-440° C for gas oil.

Preferred adsorption pressures also vary with the feedstock, being 5-500 psia for gasoline and 5-50 psia for kerosine and gas oil.

The preferred intermediate urge pressure also depends upon the actual boiling range of the feedstock. For example, when treating a gasoline fraction of average carbon number about $C_7$ boiling in the range $C_4$ - 180° C, a purge pressure range of 2-50 psia is preferred, while 5-150 torr is preferred for kerosine range fractions of average carbon number about $C_{11}$ boiling between 150°-250° C, and for gas oil fractions.

Similarly, the preferred desorption pressure varies according to the feedstock boiling range, being in the range 10-300 torr for gasline and 0.1-20 torr for kerosine and gas oil fractions.

For kerosine and gas oil feedstocks, the pressure reduction in the third stage, desorption, is preferably achieved by direct condensation with recycled n-paraffin product. For a gasoline feedstock the pressure reduction in the third stage is preferably achieved by means of an ejector, for example as described in U.S. Pat. No. 3,922,218 issued Nov. 25, 1975.

It is to be understood that during the adsorption stage, pressure is increasing and the quoted figures relate to the maximum pressure achieved at the end of the stage. The initial pressure may well be outside the quoted range.

Conversely, during purging and desorption, pressure is decreasing and the quoted figures relate to the minimum pressure achieved at the end of each stage. Again, the initial pressures may well be outside the ranges.

The durations of the three stages may be such that the desorption plus purge duration is a simple multiple of the adsorption duration. Alternatively, and preferably, however, the durations of the adsorption and desorption are whole-number multiples of the purge. The purge duration should not exceed three minutes, one to two minutes being preferred. The adsorption and desorption periods may be, respectively, 1-5, preferably 1-2 minutes and 2-10, preferably 3-8, minutes.

The process is preferably operated using a number of fixed beds of sieve so that at any given time, one or more beds are adsorbing, purging and desorbing. The ratio of the number of beds respectively, adsorbing, purging and desorbing at any given moment is preferably the same as the ratio of the durations of the adsorption, purge and desorption stage. This ratio may be 1:1:*n* where $n$ is an integer between 1 and 6, 1:1:3 being preferred. Thus, for example, with a ratio of 1:1:3, a total of 5 sieve beds is required. A further additional bed may also be provided to permit periodic regeneration, e.g., by burning off, to remove carbonaceous deposits without interrupting the adsorption-purge-desorption cycle.

The feed rate to the adsorption stage is preferably 0.5–4.0 v/v/hr, particularly 1.5–3.0 v/v/hour.

The invention is illustrated by the drawing accompanying the Provisional Specification which is a flow diagram of a unit incorporating the invention.

The unit comprises a series of beds 1, each of which in turn adsorbs and is purged and desorbed. Each bed when being purged is connected to a direct contact purge condenser 2 and when being desorbed to a direct contact desorption condenser 3.

Feed at or near ambient temperature is supplied to the unit through the line 4 into the purge condenser 2 where it mixes with the condenses purged vapours, thereby drawing a vacuum on the bed 1 being purged. Liquid is withdrawn from the base of the condenser 2 by a line 5 and a portion is recycled through the line 6 to the top of the condenser 2, passing through the cooler 7 on the way. A second portion of the liquid is led by line 9 to drum 10 and through heat exchanger 11 and feed heater 12 to a bed 1 where adsorption takes place.

Effluent from the adsorber bed, i.e., denormalised product, is withdrawn by the line 13 and gives up heat to the adsorber feed in the heat exchanger 11. It then passes by way of drum 14 and cooler 15 out of the unit as product by line 16.

After adsorption is complete, valves (not shown) are operated and the bed 1 is connected to the purge condenser 2 by line 17 where it is purged as previously described.

After purging is completed, valves (not shown) are operated and the bed 1 is connected to the desorption condenser 3 by the line 18. Here desorbed effluent, i.e., n-paraffin product, is contacted with cooled recycled n-paraffin product which condenses it and thereby draws a vacuum on the bed 1 being desorbed. N-paraffin product is withdrawn from the bottom of the condenser 3 by the line 19. A portion is recycled through the line 20 to the top of the condenser 3, passing through the cooler 21 on the way. A second portion passes by way of line 22 out of the unit as product.

The invention is further illustrated by the following examples of which example 1 is provided for purposes of comparison only.

EXAMPLE 1

Fresh gas oil feed at the rate of 90,151 kg/hour at a temperature of 15° C was fed to the drum 10 where it was joined by 38,315 kg/hour recycled purge material at 95° C from the purge condenser. The combined feed was passed through the heat exchanger 11 and feed heater 12 before entering the adsorber at 400° C.

490,053 kg/hour purged material at 95° C was passed through the cooler 7, cooled to 57° C and recycled to the purge condenser 2 where it was used to condense 38,315 kg/hour adsorber effluent vapour entering at 400° C. 528,368 kg/hour condensed purge was removed from the base of the condenser 2 to be divided as previously described, i.e., 49,053 kg/hour recycled to the condenser 2 and 38,315 kg/hour recycled to the feed drum 10.

EXAMPLE 2

Fresh gas oil feed at the rate of 90,151 kg/hour at a temperature of 15° C was fed directly to the purge condenser 2, together with 331,480 kg/hour recycled purge material whch had been cooled from 95° to 57° C in the cooler 7. The combined feed and recycle were brought into direct contact in the condenser 2 with 38,315 kg/hour adsorber effluent vapour entering at 400° C and used to condense the latter.

459,946 kg/hour condensed feedstock and purge material were withdrawn from the base of the condenser 2 at 95° C. 331,480 kg/hour were recycled to the condenser 2 as previously described and the remaining 128,466 kg/hour were passed to the feed drum 10, heat exchanger 11 and heater 12 before being fed to the adsorber 1 at 400° C.

Energy requirements are given below for both examples.

Table 1

| | | Ex 1 | Ex 2 |
|---|---|---|---|
| Recycle liquid cooler (7) duty | $10^6$ kcal/h | 9.31 | 6.38 |
| Feed heater (12) & heat exchanger (11) duty | $10^6$ kcal/h | 33.36 | 30.43 |
| Pump flowrate | kg/h | 528 000 | 460 000 |

We claim:

1. A cyclic, vapour phase, pressure swing process for the separation of n-paraffins from a mixture thereof with nonstraight chain hydrocarbons comprising the steps of adsorption, purge and desorption, which process comprises 1. recycling purge effluent mixed with feedstock through a bed of a 5A molecular sieve in an adsorption stage and recovering an effluent of reduced n-paraffin content,
2. purging the bed to remove surface adsorbed and interstitial matter by reducing the pressure in the bed by direct contact condensation of the purge effluent with fresh feed introduced at or near ambient temperature and recovering said purge effluent-feedstock mixture for recycle to Stage (1), and
3. desorbing the bed to recover n-paraffins by further reducing the pressure in the bed.

2. A process according to claim 1 wherein the feedstock is a gasoline fraction.

3. A process according to claim 1 wherein the feedstock is a kerosine fraction.

4. A process according to claim 1 wherein the feedstock is a gas oil fraction.

5. A process according to claim 2 wherein the operating temperature is in the range 300°– 380° C, the adsorption pressure in the range 5 – 500 psia, the purge pressure in the range 2 – 50 psia and the desorption pressure in the range 10 – 300 torr.

6. A process according to claim 3 wherein the operating temperature is in the range 350°– 400° C, the adsorption pressure is in the range 5 – 50 psia, the purge pressure in the range 5 – 150 torr and the desorption pressure in the range 0.1 – 20 torr.

7. A process according to claim 4 wherein the operating temperature is in the range 380°– 440° C the adsorption pressure is in the range 5 – 50 psia, the purge pressure in the range 5 – 150 torr and the desorption pressure in the range 0.1 – 20 torr.

8. A process according to claim 2 wherein the pressure reduction in the desorption stage is achieved by means of an ejector.

9. A process according to claim 3 wherein the pressure reduction in the desorption stage is achieved by direct contact with recycled n-paraffin product.

10. A process according to claim 1 wherein the duration of the adsorption, purge and desorption stages are 1 – 5 minutes, less than 3 minutes and 2 – 10 minutes, respectively.

* * * * *